US009618253B2

(12) United States Patent
Tansley

(10) Patent No.: US 9,618,253 B2
(45) Date of Patent: Apr. 11, 2017

(54) REFRIGERATION APPARATUS

(75) Inventor: Ian Tansley, Tywyn Gwyneed (GB)

(73) Assignee: THE SURE CHILL COMPANY LIMITED, Tywyn Gwynedd (GB)

( * ) Notice: Subject to any disclaimer, the term of this patent is extended or adjusted under 35 U.S.C. 154(b) by 313 days.

(21) Appl. No.: 13/383,118

(22) PCT Filed: Jul. 9, 2010

(86) PCT No.: PCT/GB2010/051129

§ 371 (c)(1),
(2), (4) Date: Jan. 9, 2012

(87) PCT Pub. No.: WO2011/007162

PCT Pub. Date: Jan. 20, 2011

(65) Prior Publication Data

US 2012/0102994 A1 May 3, 2012

(30) Foreign Application Priority Data

Jul. 15, 2009 (GB) ..... 0912286.2
Sep. 15, 2009 (GB) ..... 0916160.5

(51) Int. Cl.
*F25B 27/00* (2006.01)
*F25D 11/00* (2006.01)
*F25D 16/00* (2006.01)

(52) U.S. Cl.
CPC ..... *F25D 11/003* (2013.01); *F25D 11/006* (2013.01); *F25D 16/00* (2013.01); *F25B 27/005* (2013.01)

(58) Field of Classification Search
CPC ..... F25D 11/006; F25D 2303/083; F25D 2303/084; F25D 3/02
(Continued)

(56) References Cited

U.S. PATENT DOCUMENTS 186,200 A 1/1877 Crisfield
1,594,015 A 7/1926 McLaughlin
(Continued)

FOREIGN PATENT DOCUMENTS

CN 2062629 U 9/1990
CN 2162269 Y 4/1994
(Continued)

OTHER PUBLICATIONS

International Search Report and The Written Opinion of the International Search Authority corresponding to International Application No. PCT/GB2010/051129; Date of Mailing: Apr. 4, 2011; 11 pages.

(Continued)

*Primary Examiner* — Elizabeth Martin
(74) *Attorney, Agent, or Firm* — Perkins Coie LLP

(57) ABSTRACT

Refrigerators that can be used in the storage and transport of vaccines are disclosed. A refrigerator has a payload container (20) within which items can be placed for temperature-controlled storage. The payload container (20) is submerged in a reservoir (21) that contains water. The reservoir has a cooling region containing the payload container and a headspace containing water that is, in use, higher than the payload container. Cooling means, that might include a refrigeration unit (30) having cooling elements (32) or a cold thermal mass can cool water within the headspace. Where there is a refrigeration unit, a power supply, typically solar powered, can act as a source of power for the refrigeration unit. Embodiments may include a freezer compartment close to the cooling elements (32). Alternatively, the cooling region includes a pipe manifold within the payload container.

31 Claims, 11 Drawing Sheets

(58) Field of Classification Search
USPC ..... 62/235.1, 236, 59, 438, 457.1, 457.2, 62/457.9
See application file for complete search history.

(56) References Cited

U.S. PATENT DOCUMENTS

| | | | | |
|---|---|---|---|---|
| 1,988,549 | A | 1/1935 | Gibson | |
| 2,046,967 | A | 7/1936 | Post, Jr. et al. | |
| 2,641,109 | A | 6/1953 | Muffly | |
| 3,609,991 | A | 10/1971 | Chu et al. | |
| 4,509,587 | A | 4/1985 | Clark et al. | |
| 4,715,195 | A | 12/1987 | Kucza | |
| 4,958,506 | A * | 9/1990 | Guilhem | A01N 1/02 62/119 |
| 5,129,238 | A | 7/1992 | Schwartz et al. | |
| 5,237,835 | A * | 8/1993 | Brochier | F25D 17/02 62/336 |
| 5,408,845 | A | 4/1995 | Clarke et al. | |
| 5,627,310 | A * | 5/1997 | Johnson | 73/64.53 |
| 5,782,095 | A | 7/1998 | Chen | |
| 6,314,751 | B1 | 11/2001 | Gjersvik | |
| 6,415,624 | B1 | 7/2002 | Connors et al. | |
| 6,469,487 | B2 * | 10/2002 | Ewert et al. | 62/228.4 |
| 6,698,210 | B2 * | 3/2004 | Ogura et al. | 62/6 |
| 7,543,455 | B1 * | 6/2009 | Chen | 62/235.1 |
| 8,516,849 | B2 * | 8/2013 | Mooijer et al. | 62/457.5 |
| 2002/0104318 | A1 | 8/2002 | Jaafar et al. | |
| 2003/0070436 | A1 * | 4/2003 | Wood et al. | 62/114 |
| 2004/0123620 | A1 | 7/2004 | Porter | |
| 2005/0229626 | A1 | 10/2005 | Akopyan | |
| 2008/0060374 | A1 | 3/2008 | Gammons et al. | |
| 2008/0092559 | A1 | 4/2008 | Williams et al. | |
| 2008/0141875 | A1 | 6/2008 | Fahrenback | |
| 2009/0151368 | A1 | 6/2009 | Bar | |
| 2010/0018221 | A1 | 1/2010 | Flinner et al. | |
| 2010/0293970 | A1 | 11/2010 | Mooijer et al. | |
| 2012/0102994 | A1 | 5/2012 | Tansley | |
| 2014/0360214 | A1 | 12/2014 | Tansley | |
| 2016/0018151 | A1 | 1/2016 | Tansley | |
| 2016/0216023 | A1 | 7/2016 | Tansley et al. | |

FOREIGN PATENT DOCUMENTS

| | | | | |
|---|---|---|---|---|
| CN | 1133631 | A | 10/1996 | |
| CN | 2379760 | Y | 5/2000 | |
| CN | 201451827 | U | 5/2010 | |
| DE | 3627201 | A1 | 4/1987 | |
| DE | 41 42 842 | A1 | 4/1993 | |
| DE | 44 25 213 | A1 | 1/1996 | |
| EP | 0 038 864 | | 11/1981 | |
| EP | 0 491 671 | A1 | 6/1992 | |
| EP | 491671 | A1 | 6/1992 | |
| EP | 505208 | A2 | 9/1992 | |
| EP | 1 538 409 | A2 | 6/2005 | |
| FR | 2537712 | A1 | 6/1984 | |
| FR | 2 562 218 | | 10/1985 | |
| GB | 165684 | | 7/1921 | |
| GB | 494531 | | 10/1938 | |
| GB | 1 429 678 | A | 3/1976 | |
| GB | 2 235 968 | A | 3/1991 | |
| GB | 2235968 | A * | 3/1991 | F25D 15/00 |
| GB | 2 281 773 | A | 3/1995 | |
| GB | 2 430 724 | A | 4/2007 | |
| GB | 2 457 054 | A | 8/2009 | |
| GB | 2471865 | A | 1/2011 | |
| JP | H0579741 | A | 3/1993 | |
| JP | 10-144361 | A | 5/1998 | |
| JP | 2001133109 | A | 5/2001 | |
| JP | 2001221553 | A | 8/2001 | |
| JP | 2001227847 | A | 8/2001 | |
| JP | 2002013855 | A | 1/2002 | |
| JP | 2003148849 | A * | 5/2003 | F25D 11/00 |
| JP | 2004043020 | A | 2/2004 | |
| SU | 898226 | A1 | 1/1982 | |
| WO | 2009005008 | A1 | 1/2009 | |
| WO | WO 2009/072876 | A1 | 6/2009 | |
| WO | WO 2010/086167 | A1 | 8/2010 | |
| WO | 2011007162 | A2 | 1/2011 | |
| WO | 2013089678 | A1 | 6/2013 | |

OTHER PUBLICATIONS

Colombian Examination Report for Colombian Application No. 14-163243 with International filing date of Jan. 28, 2013; Mailed Jul. 14, 2015.
Exam Report for Egyptian Application EG2012010066 filed Dec. 1, 2012; 7 pages.
First Office Action mailed Dec. 26, 2014, for Eurasian Patent Application No. 201270161.
First Office Action mailed Jun. 2, 2015, for Japanese Patent Application No. 2012-520097.
First Office Action mailed Mar. 25, 2015, for Vietnamese Patent Application No. 1-2012-00156.
First Office Action mailed Nov. 12, 2014, for Mexican Patent Application No. MX/A/2012/000719.
First Office Action mailed Sep. 5, 2014, for Philippines Patent Application No. 12012500102.
Great Britain Examination Report for GB Application 1401455.9; Mail Date Sep. 15, 2014.
International Search Report and Written Opinion mailed May 6, 2015, for International Patent Application No. PCT/GB2014/050218 filed Jan. 28, 2014.
International Search Report and Written Opinion mailed Sep. 26, 2014, for International Patent Application No. PCT/GB2014/052255 filed Jul. 23, 2014.
Second Office Action mailed Apr. 3, 2015, for Eurasian Patent Application No. 201270161.
Second Office Action mailed Aug. 4, 2015, for Japanese Patent Application No. 2012520097.
Second Office Action mailed Jul. 1, 2015, for Mexican Patent Application No. MX/A/2012/000719.
Second Office Action mailed Jun. 1, 2015, for Philippines Patent Application No. 12012500102.
Substantive Search and Examination Report mailed May 11, 2014, for ARIPO Application No. AP/P/2012/006111 filed Sep. 7, 2010, 32 pages.
Colombian Examination Report for Colombian Application No. 15-202569 with International filing date of Jan. 28, 2014; Mailed Sep. 9, 2016.
Exam Report for Egyptian Application EG2014071169, mail date Aug. 1, 2016; 7 pages.
Examination Report for Canadian Application No. 2,767,864, mail date May 13, 2016, 4 pages.
Examination Report for United Kingdom Patent Application No. GB1201437.9, mail date Apr. 7, 2014, 2 pages.
First Office Action mailed Apr. 21, 2016, for Eurasian Patent Application No. 201491428, 5 pages.
First Office Action mailed Nov. 6, 2015 for Chinese Patent Application No. 201380017447.3, 66 pages, with English Translation.
Non-Final Office Action mailed Aug. 3, 2016, for U.S. Appl. No. 15/003,386 of Tansley, Ian filed Jan. 21, 2016.
Office Action in Eurasian Patent Application No. 201591385/31, mail date Aug. 30, 2016, 6 pages.
Office Action in Thailand Patent Application No. 1401004332, mail date May 28, 2015, 1 page.
Patent Examination Report No. 1 for Australian Application No. 2015202391, mail date May 2, 2016, 3 pages.
Restriction Requirement Action mailed May 16, 2016, for U.S. Appl. No. 15/003,386 of Tansley, Ian filed Jan. 21, 2016.
Second Office Action mailed Aug. 26, 2016 for Chinese Patent Application No. 201380017447.3, 37 pages, with English Translation.
Substantive Search and Examination Report mailed May 11, 2014, for ARIPO Application No. AP/P/2014/007819 filed Jan. 28, 2013, 4 pages.

(56) References Cited

OTHER PUBLICATIONS

Third Office Action mailed Mar. 28, 2016, for Eurasian Patent Application No. 201270161, 4 pages.

* cited by examiner

REFRIGERATION APPARATUS

RELATED APPLICATIONS

This application is a 35 U.S.C. §371 national stage application of PCT Application No. PCT/GB2010/051129, filed on 9 Jul. 2010, which claims priority from Great Britain Patent Application No. 0912286.2, filed 15 Jul. 2009, and from Great Britain Patent Application No. 0916160.5, filed 15 Sep. 2009, the contents of which are incorporated herein by reference in their entireties. The above-referenced PCT International Application was published in the English language as International Publication No. WO 2011/007162 A1 on 20 Jan. 2011.

This invention relates to refrigeration apparatus. It has particular, but not exclusive, application to refrigeration apparatus for use in storage and transport of vaccines, food or other perishable items in the absence of a reliable supply of electricity.

One of the greatest problems facing the distributors of vaccines in underdeveloped countries is that their viability can be destroyed by storage at improper temperatures. In general, a vaccine must be stored between +2° C. and +8° C. This is an especially difficult problem because, in many regions, this temperature must be maintained in the absence of a reliable (and potentially of any) supply of electricity to run a refrigerator, and this results in an unacceptably high proportion of all vaccines being ineffective by the time they reach their intended target. Similar problems arise with the storage of food in such circumstances.

It is natural that refrigerators that rely upon alternative sources of energy have been sought, and photovoltaic generation of electricity from sunlight has been seen as the most promising. A problem with any device that relies upon the sun as a source of energy is that the source is unavailable during night time. Conventionally, solar-powered refrigeration apparatus is provided with a rechargeable battery that is charged during daylight and which runs the apparatus at night. However, it is well known that the life of rechargeable batteries is diminished by exposure to high temperature. Failure of the battery can occur with little warning, meaning that the refrigerator can stop working resulting in spoiled contents. The life of the battery is typically much less than other components of a refrigerator: typically no more than five years for the battery, whereas the refrigerator as a whole may last twenty.

In view of these problems, the World Health Organisation (WHO)—the organisation that sets the standards for vaccine refrigerators—now encourages the use of batteryless solar refrigerators in distribution chain for vaccines in future.

One approach to meeting this requirement is to include a cold reservoir within the refrigerator, separated from a payload space of the refrigerator by a thermal barrier. The cold reservoir is a thermal mass that is cooled to a low temperature (perhaps as low as −30° C.) while solar power is available. When power becomes unavailable, the reservoir can absorb heat from the payload space. An important disadvantage of this arrangement is that it is difficult to maintain the temperature of the payload within the required temperature range. This type of apparatus presents a particular risk of overcooling vaccine: freezing can result in its immediate destruction. Freezing can also destroy or diminish the value of some food, such as fresh vegetables, or cause bottles that contain water to burst.

An aim of this invention is to provide refrigeration apparatus that can operate on solar power, yet which does not rely on batteries, and which minimises the risk to vaccine or other contents contained within it.

To this end, this invention provides a refrigerator having: a payload container within which items can be placed for temperature-controlled storage; a thermally-insulated reservoir within which the payload container is located, the reservoir containing water that at least partially immerses the payload container and extends into a headspace that is higher than the payload container; and cooling means that can cool water within the headspace.

As is well known, water has its maximum density at 4° C. Therefore, as water in the headspace is cooled towards 4° C., its density will increase, and it will therefore tend to sink towards the bottom of the reservoir. Since the payload container will adopt a temperature at or around that of the surrounding water, it will tend towards 4° C., which is an ideal temperature for storage of vaccines and many other items. The payload container is separated from the refrigeration unit, so avoiding the risk of its contents (or of its walls) dropping towards freezing point.

The cooling means may include a refrigeration unit that can cool water within the headspace, and a power supply unit that can act as a source of power for the refrigeration unit. The power supply most typically includes means, such as photovoltaic cells, for converting sunlight into electrical power.

In typical embodiments, the refrigeration unit includes an electrically-powered compressor. However, refrigeration units using other refrigeration technology might be used to increase the electrical efficiency of the refrigerator. One example of such alternative technology is a Stirling cooler, which may be operated in solar direct drive mode.

To minimise the risk of the payload space being cooled to too low a temperature, a refrigerator having a refrigeration unit may further comprise a sensor disposed to detect the formation of ice in the reservoir. The sensor may be operative to cause operation of the refrigeration unit to be interrupted upon detection of the formation of ice.

In alternative embodiments of the invention, the cooling means includes a thermal mass that, for use, is at a temperature below a target temperature of the payload space. This can provide a refrigerator that is simple in construction and that has no moving parts in operation. For example, the thermal mass may be a body of water ice. Such an arrangement may be used on its own or in combination with a refrigeration unit. This combination within the cooling means can cool the refrigerator to its working temperature better or more quickly than can the refrigeration unit alone.

Such embodiments may include a compartment for receiving the thermal mass in thermal communication with water in the headspace. For example, the compartment may be suitable for receiving ice. Alternatively, the thermal mass may be immersed in water within the headspace. In this latter case, the thermal mass may be an ice pack.

The payload space may be contained within the cooling region. For example, it may be submerged within the cooling region. This allows maximal heat transfer between the payload space and the water. Alternatively, the cooling region may be contained within the payload space. It may include one or more water-carrying passages that extend through the payload space, for example, in the form of a manifold. This arrangement may be simpler to construct, but the rate of heat transfer from the payload space to the water may be less.

The headspace may be located, in use, directly above the payload container. In such embodiments, the payload container typically has an opening and a closure such as a door on one side of the payload container. Alternatively, the headspace may be located, in use, to one side of the payload container. In such embodiments, the payload container typically has an opening and a closure such as a door on the top of the payload container.

Most typically, a payload space within the payload container is in close thermal communication with the water in the reservoir. This ensures that the payload is maintained at a temperature approximately that of the water. The reservoir is most preferably insulated to minimise transfer of heat between water within the reservoir and surroundings of the refrigerator.

Embodiments of the invention may further include a freezer compartment. Typically, the freezer compartment is in close thermal communication with a cooling element of the refrigeration unit. This ensures that it is cooled to a significantly lower temperature than the water. The freezer compartment may have an opening that is closed by an insulated door. The insulated door may or may not also close the payload container.

An advantageous form of construction of embodiments of the invention may have an outer case within which is contained a water-containing liner. The liner may be formed of flexible plastic material. In these embodiments, the outer case typically provides structural strength and thermal insulation for the refrigerator.

Embodiments of the invention will now be described in detail, by way of example, and with reference to the accompanying drawings, in which.

Figure 15A:
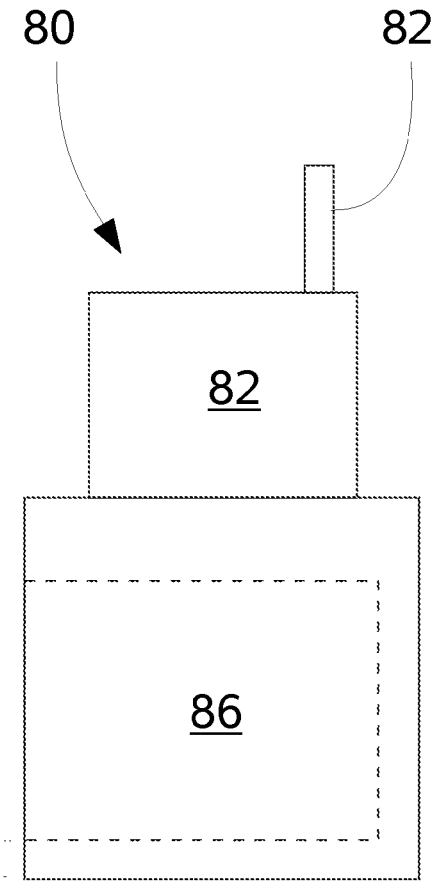
Figure 15B:
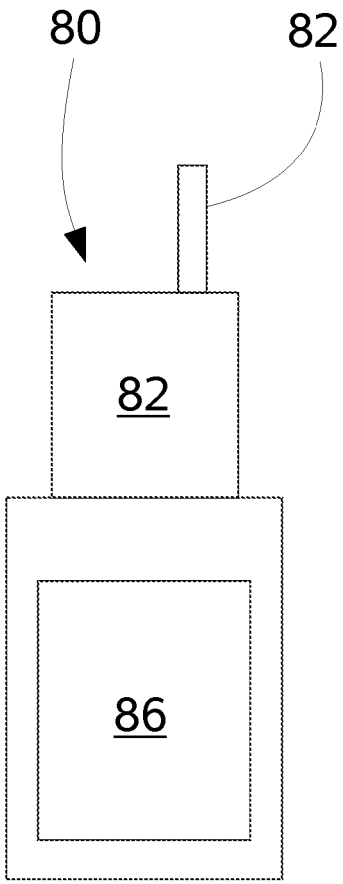
Figure 15C:
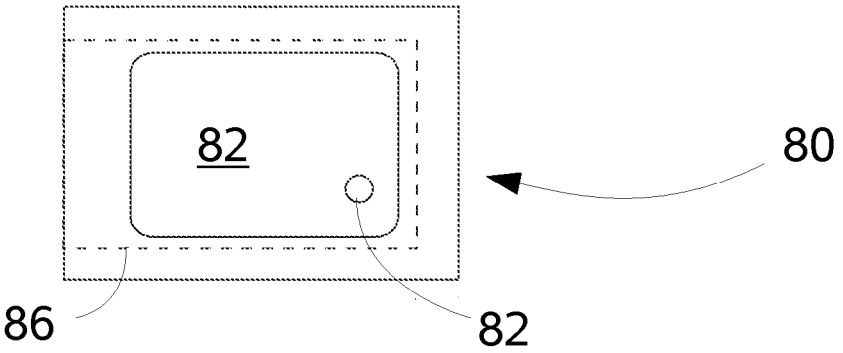

FIGS. 15*a* to 15*c* are orthographic views of a watertight liner for use with an embodiment of the invention.

Figure 1:
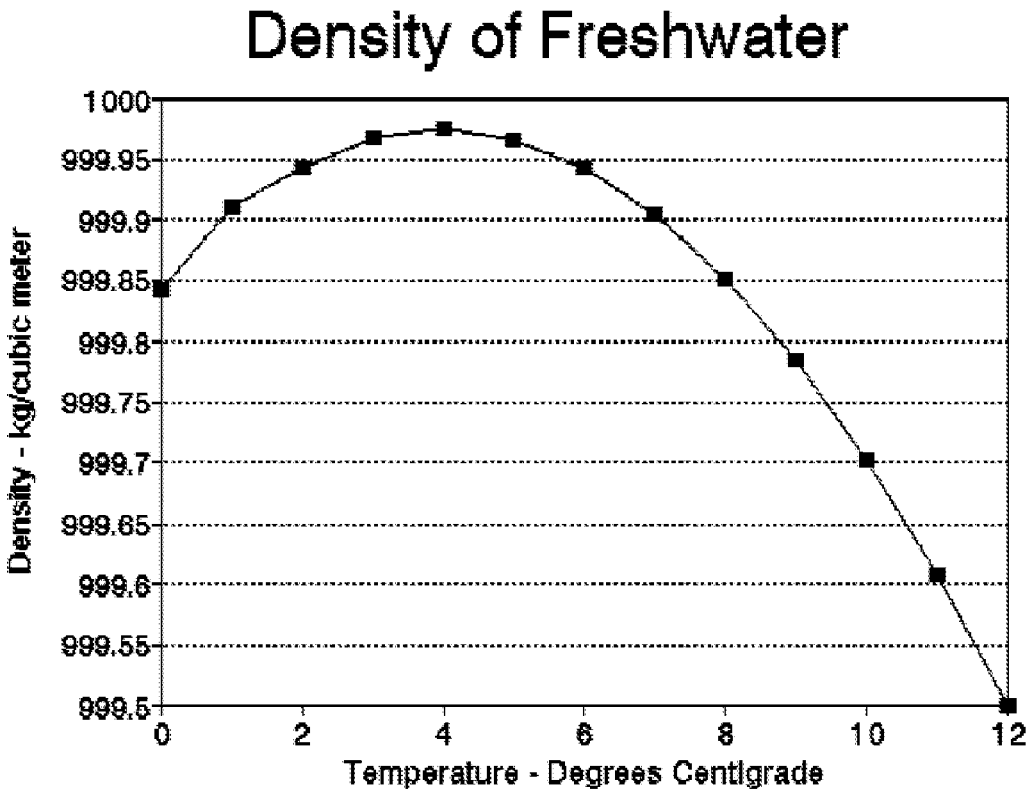
FIG. 1 is a graph of the density of water against temperature.

Operation of the embodiment relies upon one of the well-known anomalous properties of water: namely, that its density is maximum at approximately 4° C., as shown in FIG. 1. This means that a tank of water that is cooled close to its top will form a temperature gradient, whereby the water towards the bottom of the tank will approach 4° C. The temperature at the bottom of the tank will not fall below this value unless the greater part of the water in the tank becomes frozen.

Figure 3:
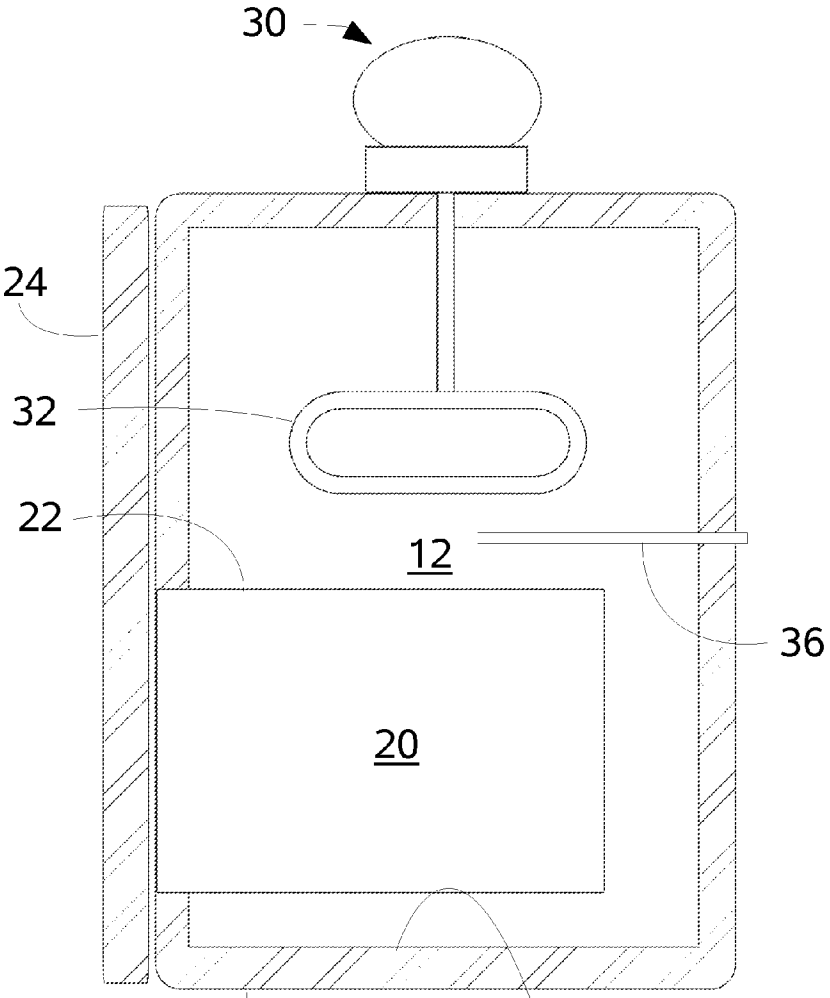
FIGS. 2 and 3 are front and side views of a front-loading refrigerator, being a first embodiment of the invention.
Figure 2:
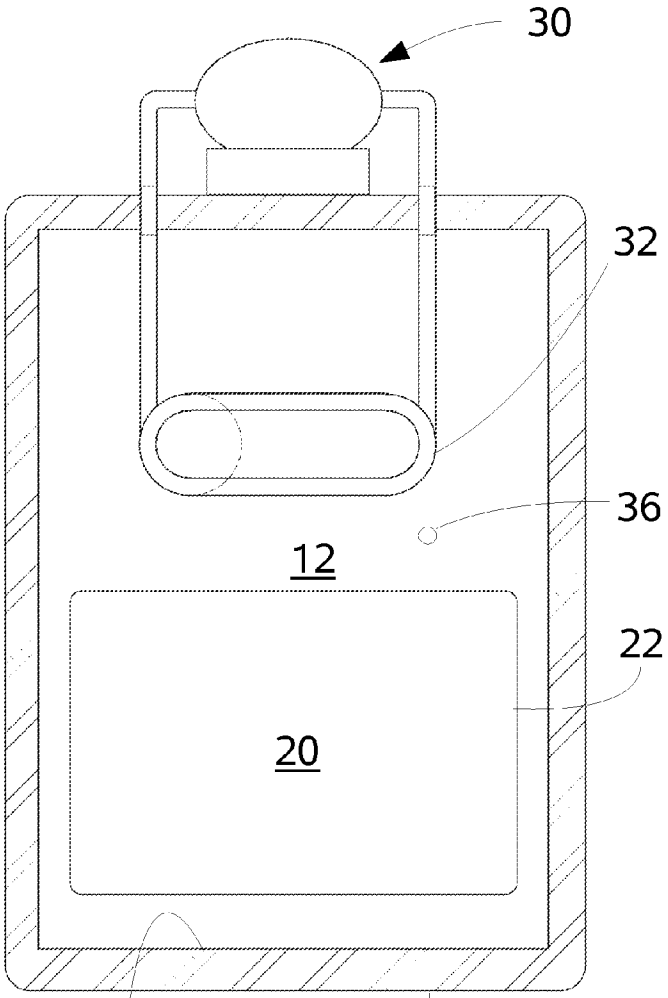

With reference to FIGS. 2 and 3, a refrigerator being a first embodiment of the invention will now be described.

The embodiment comprises a casing 10, which is, in this embodiment, shaped generally as an upright cuboid. The casing 10 is constructed to be a reservoir that, in use, contains a volume of water within an internal space 12. For instance, the casing 10 may be formed as a one-piece rotational moulding of plastic material. Insulating material 14 is carried on outer surfaces of the casing 10 to minimise flow of heat through the casing to or from the water contained within it. The water largely fills the internal space 12, but a small volume may be left unfilled to allow for expansion.

A payload space 20 is formed within the casing 10. The payload space 20 is located within a generally cuboidal box 22 that has one open face that opens horizontally to the exterior of the casing. The typical volume of the payload space in embodiments may be in the range of 50 to 100 liters, but other embodiments, for specialist purposes, may have greater or lesser capacities. The other faces are located within the casing 10 and are submerged under the water that is contained within the casing 10. The submerged faces of the cuboidal box 22 have no insulation so that they are in thermal communication with the surrounding water in a cooling region of the reservoir. The box 22 may optionally be integrally formed with the casing 10. When the refrigerator is disposed for use, the payload space 20 extends from close to the lowermost surface of the internal space 12 of the casing to appropriately half way towards the uppermost surface of the internal space 12.

A door 24 is mounted on the casing 10. The door 24 can be opened to gain access to the payload space 20 through the open face. Insulating material is carried on the door 24 so that, when it is closed, it minimises the amount of heat that can be transferred through it into or out of the payload space 20.

A refrigeration unit 30 is carried on a top surface of the casing 10. In this embodiment, the refrigeration unit is a conventional electrical compressor-based cooling unit. The refrigeration unit 30 has a cooling element 32 that extends into the internal space 12 of the casing 10 and is submerged in the water. The cooling element 32 is located in a water-filled headspace above the box 22 such that it is spaced from the box 22 by a layer of water and likewise spaced from the uppermost surface of the internal space 12. (Alternatively, the refrigeration unit 30 may have a wrap-around evaporator that surrounds the headspace.) An optional ice probe 36 is located within the casing 10 above the box 22 but below the cooling element. The ice probe 36 is electrically connected to control the refrigeration unit 30, as will be described below.

The refrigerator has an external power supply to feed the refrigeration unit 30. The power supply can operate from a supply of mains voltage (derived from a power grid or from a local generator) in the absence of bright sunlight. The power supply can also operate from photovoltaic panels, whereby the refrigeration unit 30 can be run without the need of a mains supply during sunny daytime conditions.

Operation of the refrigerator will now be described.

When the refrigerator is first started, it can be assumed that all of the water is at or around the ambient temperature. The refrigeration unit 30 is run to cause its refrigeration element 32 to cool to a temperature that is typically well below the freezing point of water—for example, as low as −30° C. This, in turn, causes water in the immediate surroundings of the cooling element to cool. As the water cools, its density increases. This sets up an effect, whereby the cooled water sinks in the casing 10, so displacing warmer water below. This warmer water rises, and is, in turn, cooled. The average temperature of all of the water within the casing 10 falls. However, once the temperature of the water surrounding the cooling element 32 approaches 4° C., the rate of the effect decreases. This causes the lower part of the water to become comparatively stagnant, with a temperature of around 4° C. The water immediately surrounding the cooling element may fall below this, or may eventually freeze. However, the ice formed by this freezing will be less dense than the warmer water below, so the ice will float upwards. Ice may continue to form, and grow downwards as cooling continues. Once the growing ice reaches and is detected by the ice probe 36, power to the refrigeration unit 30 is cut, so no further ice will form. In this embodiment, there is still a clear layer of liquid water between the lowest part of the ice and the top of the box 22, whereby the box 22 and anything within the payload space will remain above the freezing point of water. However, the extent to which ice can be allowed to grow in any particular embodiment without potentially harming a payload can be determined by experimentation.

Once the refrigeration unit 30 stops, assuming that ambient temperature is higher than the temperature of the water, energy will pass through the walls of the casing 10 into the water, which will start to warm. In the reverse of the cooling process, water in the lower part of the casing 10 will tend to stay around 4° C. while the ice melts. Following complete melting, the water will continue to warm, but water above 4° C. will tend to rise to the top of the casing 10. Thus, the payload space 20 will be maintained at or around 4° C. for as long as possible. As is well-known, a large amount of energy is required to melt ice—the latent heat of fusion. This acts as a sink of a large amount of energy that is absorbed by the water, the payload space being maintained at a substantially constant temperature during the time that the ice melts. The payload of the refrigerator is therefore maintained at around 4° C., which is an ideal temperature for storage of vaccine and of food and drink.

Figure 5:
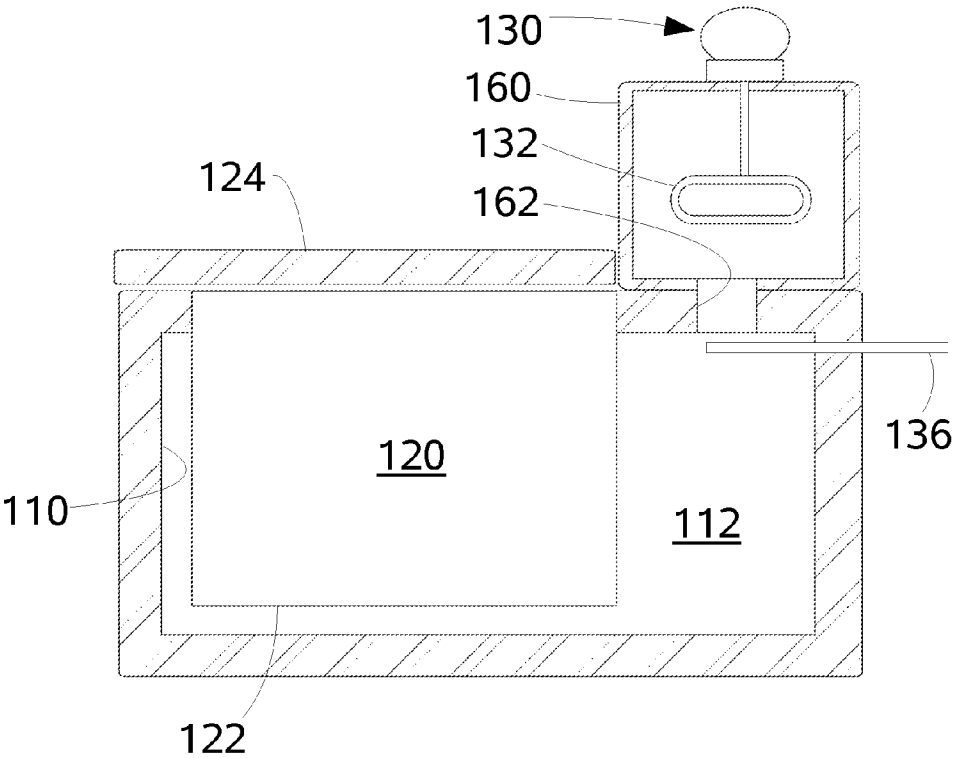
FIGS. 4 and 5 are front and side views of a top-loading refrigerator, being a second embodiment of the invention.
Figure 4:
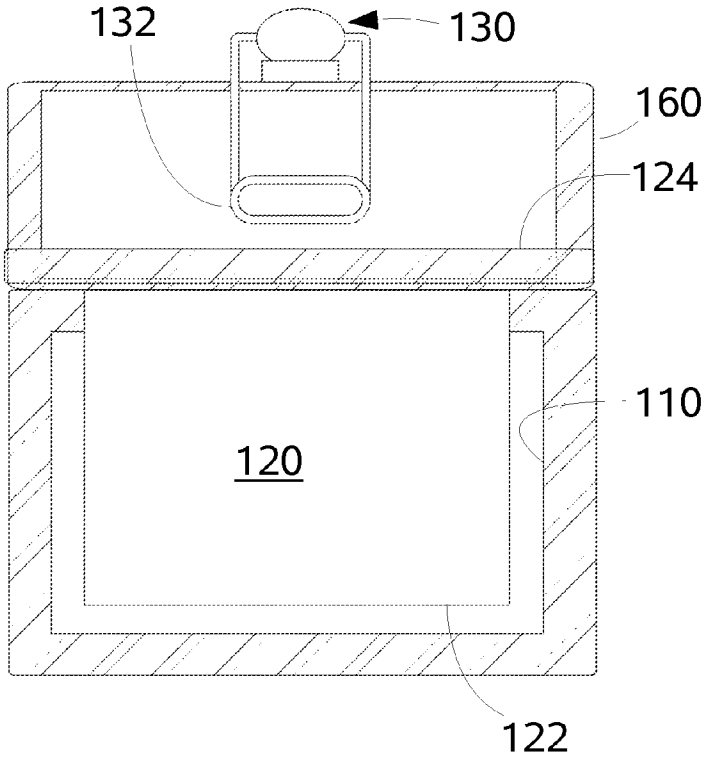

FIGS. 4 and 5 show a second embodiment of the invention: this has essentially the same components as the first embodiment. However, their layout is somewhat different. In the following description, components of the second embodiment will be given reference signs that are 100 greater than the corresponding components of the first embodiment.

In the second embodiment, the casing 110 is comparatively squatter in shape than that of the first embodiment. The opening of the box 122 faces upwards, and the door 124 opens upwards. Water surrounds the box on all sides but for the top opening, with the internal space 112 including an additional volume adjacent to one side of the box 122. A supplementary chamber 160, also containing water, is located on an upper surface of the box 122 above the additional headspace volume and adjacent to the door 124. A passage 162 interconnects the supplementary chamber 16*o* and the additional volume of the internal space 112 that allows water to pass between them. An ice sensor 136 is located adjacent to the passage 162 within the internal space 112.

A refrigeration unit 130 is carried on an upper surface of the supplementary chamber 160, with a cooling element 132 extending from it into the supplementary chamber 160.

This embodiment operates substantially as described above. Water that is cooled within the supplementary chamber passes into the internal space 112 through the passage 162. As before, the water that is densest—that at round 4° C.—sinks into the internal space 112 to cool the box 122 and the payload within it.

Figure 6:
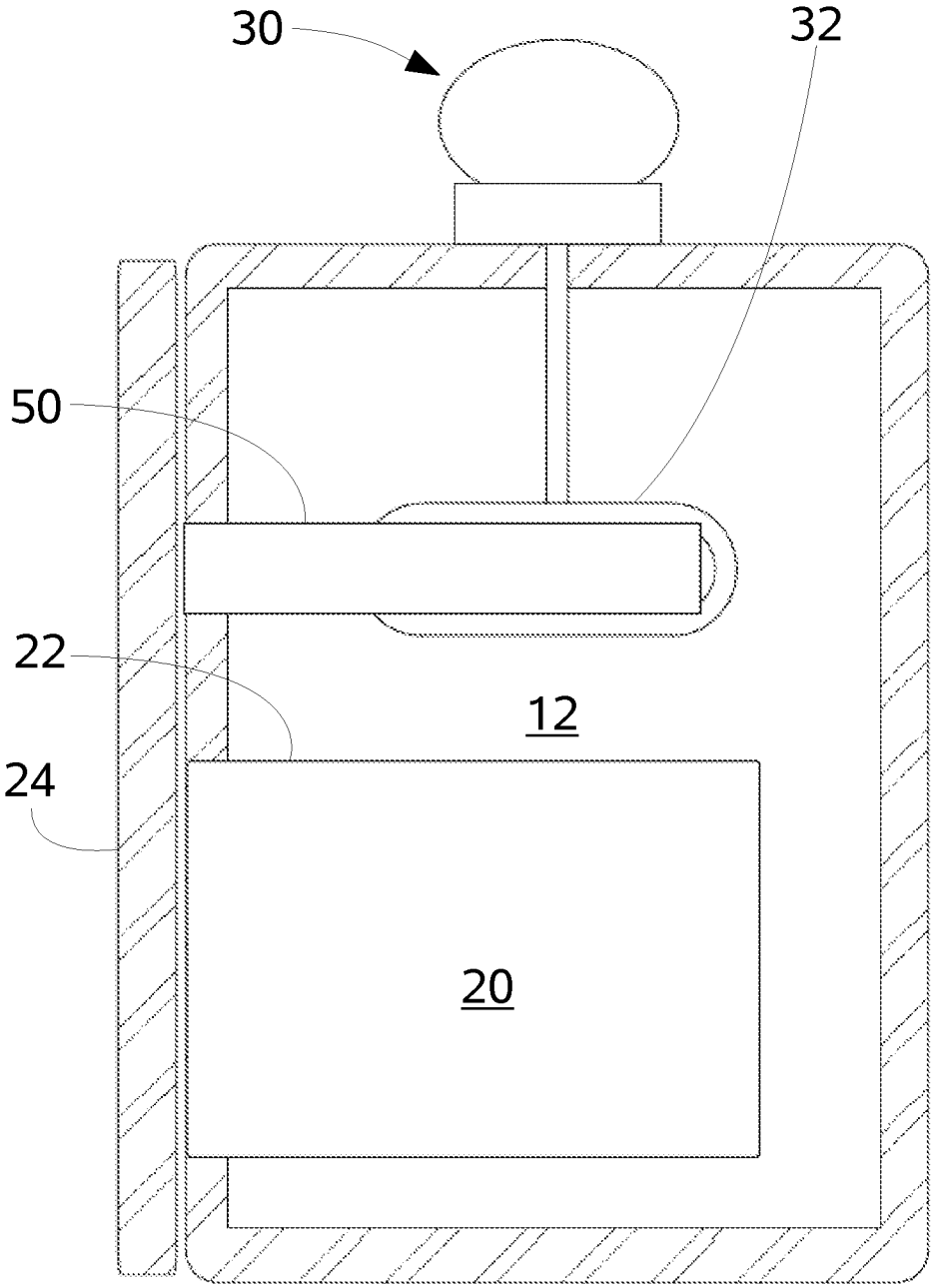
FIG. 6 is a side view of a front-loading refrigerator and freezer, being a third embodiment of the invention.
Figure 7:
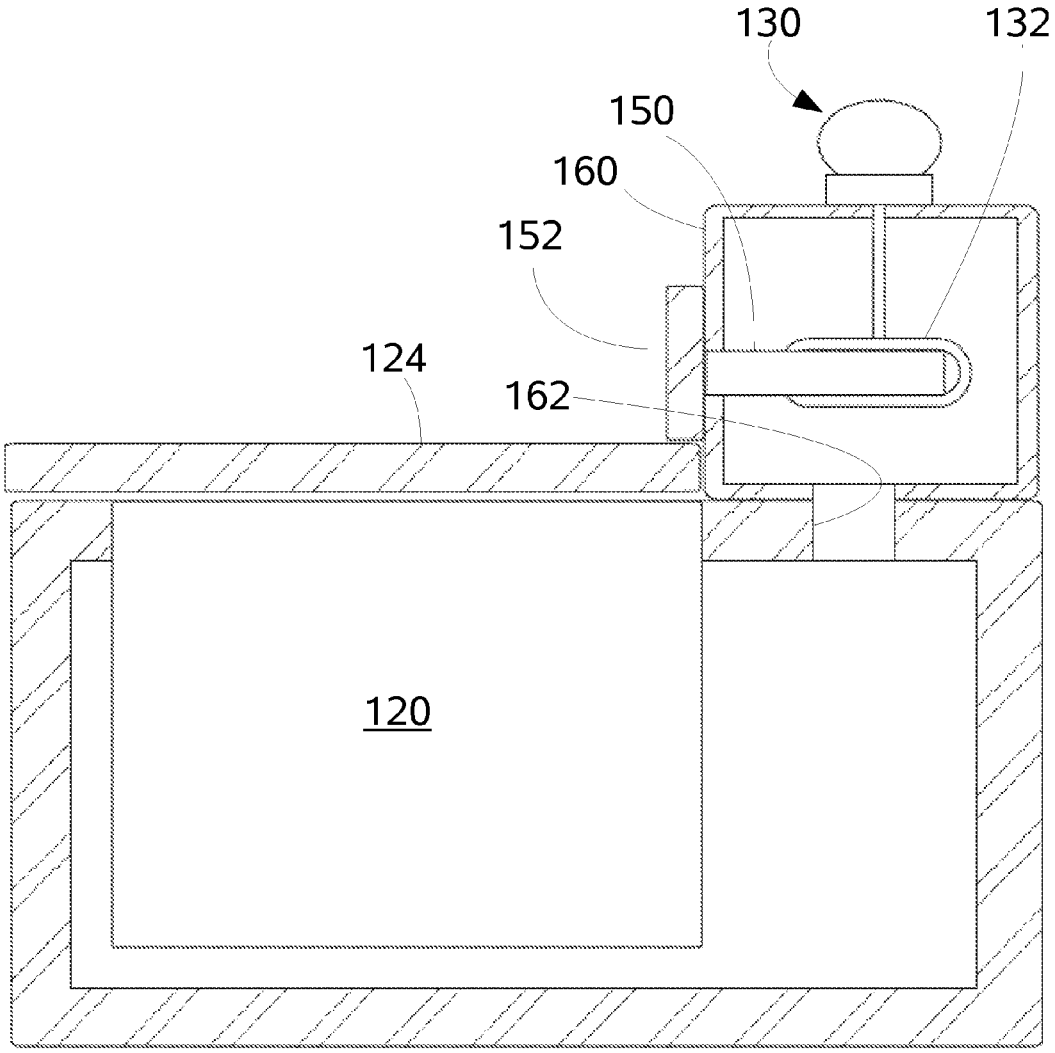
FIG. 7 is a side view of a top-loading refrigerator and freezer, being a fourth embodiment of the invention.

The third embodiment, shown in FIG. 6 corresponds closely to the first embodiment of FIGS. 2 and 3, while the fourth embodiment of FIG. 7 corresponds closely to the second embodiment of FIGS. 4 and 5. Therefore, only the additional features present will be described.

The third and fourth embodiments add the ability to maintain items in a frozen condition to the first and second embodiments. The freezer compartment is in close thermal contact with a cooling element, such that it is cooled to a temperature well below that of the water.

In the third embodiment, a freezer compartment 50 is provided, that has similar construction to the payload space 22, and similarly has a horizontal opening that is closed by the door 24. The freezer compartment 50 is located directly above the payload space, in close proximity to, or surrounded by, the cooling element 32 of the refrigeration unit 30.

In the fourth embodiment, the opening of the freezer compartment 150 is horizontal and above that of the payload space 120. In the fourth embodiment, the opening of the freezer compartment 150 is horizontal and beside that of the payload space 120. The freezer compartment 150 is enclosed within the supplementary chamber 160, in close proximity to, or surrounded by, the cooling element 132 of the refrigeration unit 130. In this embodiment, the freezer compartment 150 has an insulated door 152 that is separate from the door 124 of the payload space 120. The door 152 closes a horizontal opening of the freezer compartment 150.

Figure 8:
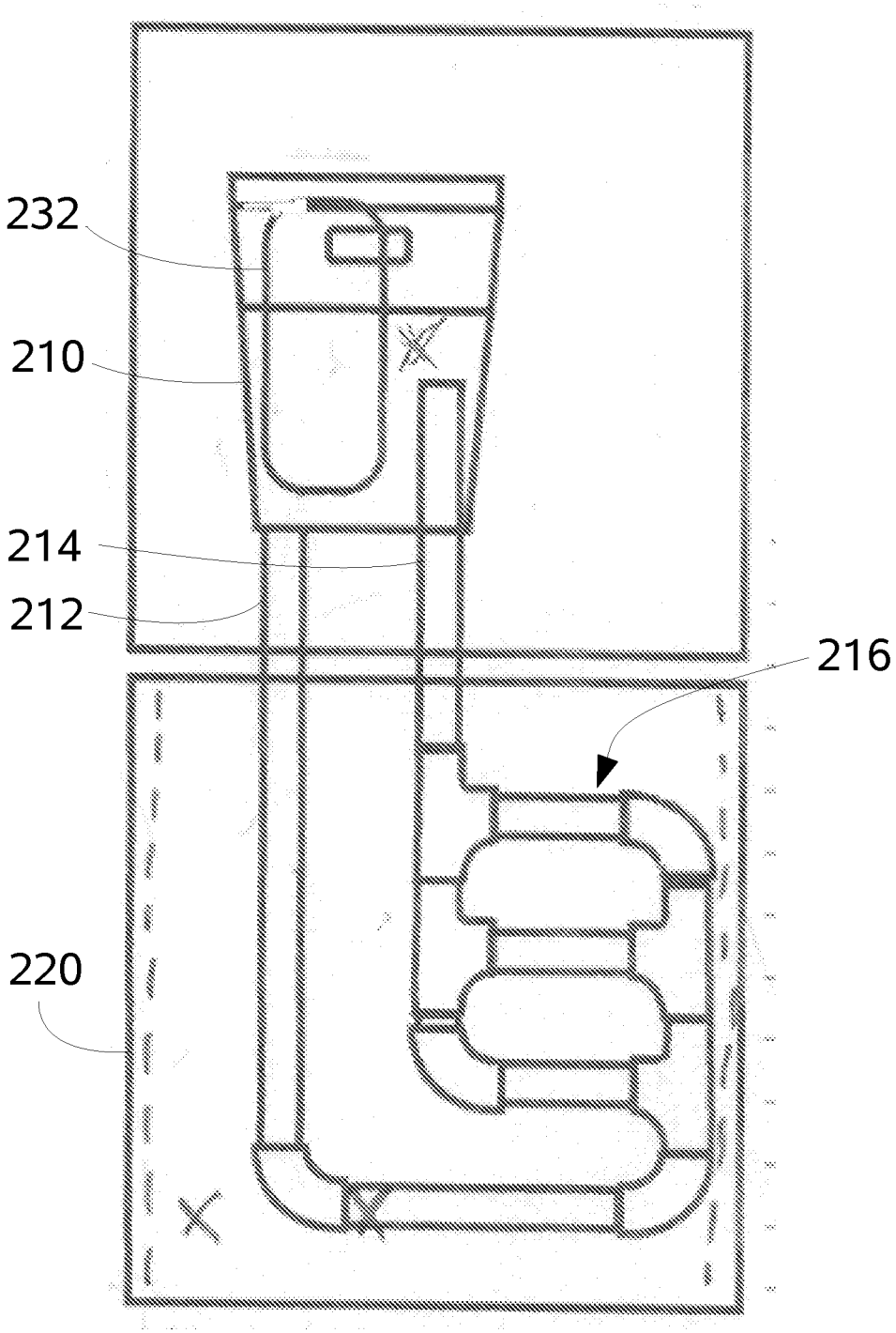
FIG. 8 is a schematic section of a fifth embodiment of the invention.

A fifth embodiment, shown in FIG. 8, has a somewhat different construction from the previous embodiments, but operates on the same principles.

In this embodiment, the reservoir comprises an upper compartment 210 mounted above a payload container 220 to form a headspace. The reservoir includes first and second water ducts 212, 214 that extend generally downwards, when in use, into the payload container 220. The first duct 214 opens into the headspace at or close to a lowermost wall, while the second duct 214 extends upwards into water contained within the headspace. Within the payload container 220, a manifold of several pipes 216 are connected to flow in parallel between the two ducts 212, 214. A refrigeration unit is provided with cooling elements 232 that can cool water within the headspace.

As with the preceding embodiments, the densest water will tend to flow towards the bottom of the reservoir—in this case, into the ducts 212, 214 and manifold 216 within the payload container 220, where heat can be exchanged between the water within the reservoir and the contents of the payload container 220. A thermo-siphon process becomes established that transfers heat away from the payload container into the headspace as the temperature of the payload container falls towards 4° C.

In yet further embodiments, there may be several payload containers within the reservoir to allow items that are to be carried to be kept separate.

Figure 9:
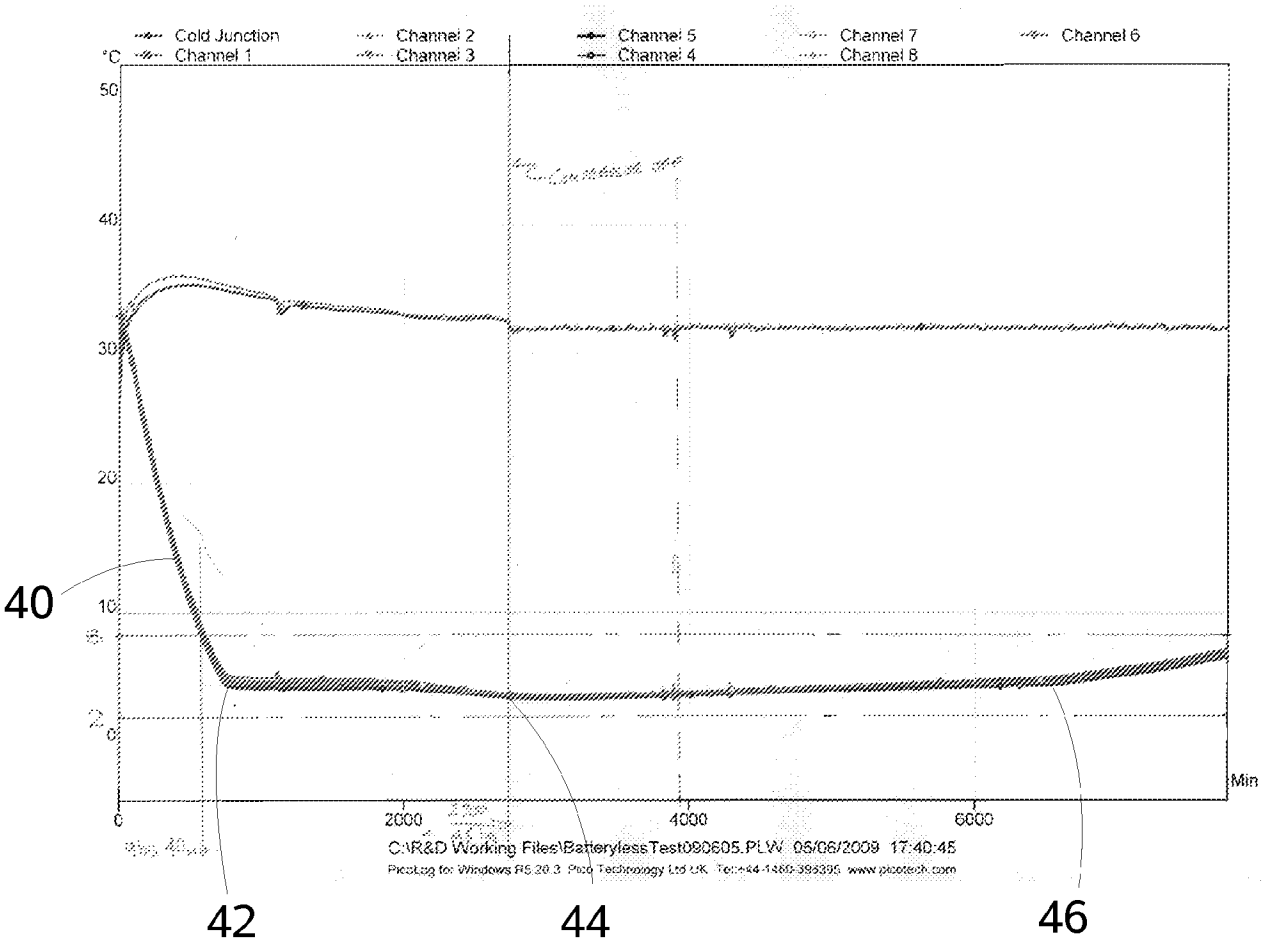
FIG. 9 is a graph showing changes in temperature within a payload space of an embodiment of the invention.

As shown in FIG. 9, when the refrigeration unit 30, 13 is first turned on (at 0 on the X-axis), the temperature in the payload space 20, 120 (as shown by the trace 40) drops quickly to 4° C., when the temperature stabilises (at 42). The temperature does not drop substantially, notwithstanding that refrigeration unit 30 continues to run. At 44, the refrigeration unit stops. The temperature in the payload space 20 then rises only very slowly for a considerable amount of time before starting to rise more rapidly. In the example shown in FIG. 9, the refrigeration unit runs for 9 hours and 40 minutes before the payload space reaches the maximum tolerable value of 8° C. Approximately an hour later, the temperature has dropped to 4° C. The refrigeration unit 30, 13 is then run for a further 34 hours approximately, without the temperature dropping significantly. Once the refrigeration unit 30, 130 is stopped, roughly 58 hours passes without a substantial rise in temperature. Then the temperature does start to rise, but over 16 hours passes before the maximum permissible 8° C. is reached.

This performance is substantially beyond that required by the World Health Organisation for vaccine storage, and is ideally suited for use with a power supply that relies upon energy derived from sunlight. It is significantly more than adequate to maintain the contents at the required temperature overnight, and, should it be necessary, through a period of cloudy weather when the supply of electrical power is limited. It should be noted that this level of performance is reached without any backup source of power such as a rechargeable battery.

The above description assumes that the maximum density of water occurs at 4° C., which is the case for pure water. The temperature at which the maximum density occurs can be altered by introduction of impurities into the water. For example, if salt is added to the water to a concentration of 3.5% (approximately that of sea water) then the maximum density occurs at nearer 2° C. This can be used to adjust the temperature of the payload space for specific applications.

Figure 11:
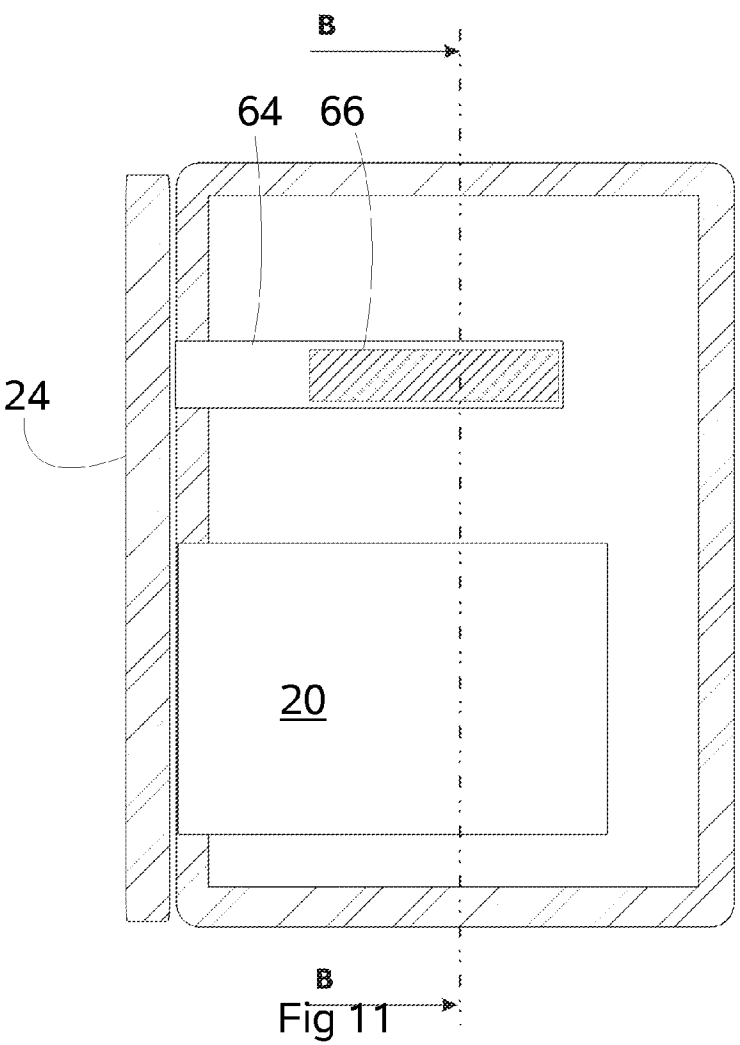
FIGS. 10 and 11 are sectional views of a front-loading refrigerator being a sixth embodiment of the invention.
Figure 10:
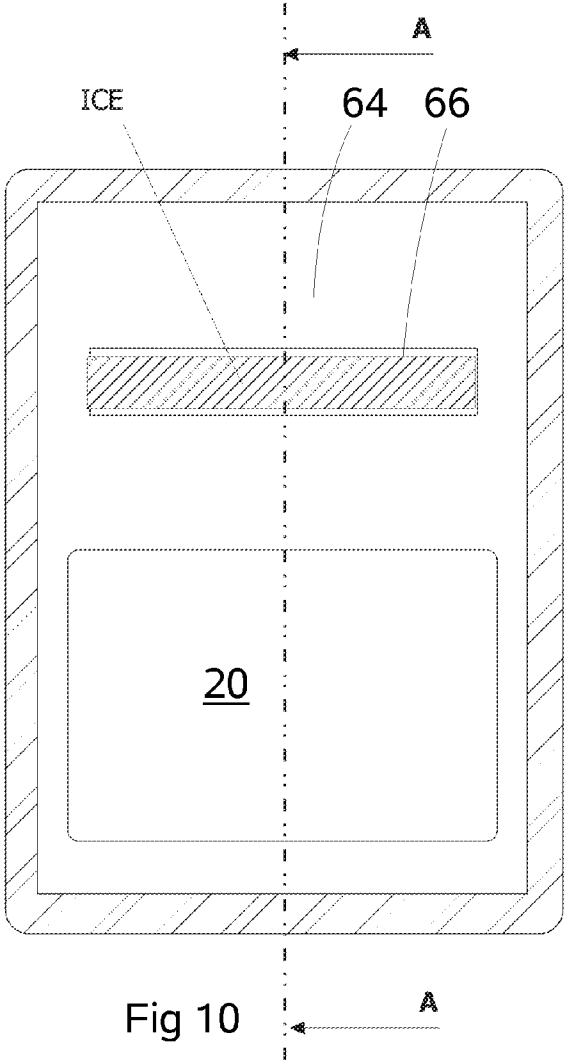
Figure 12:
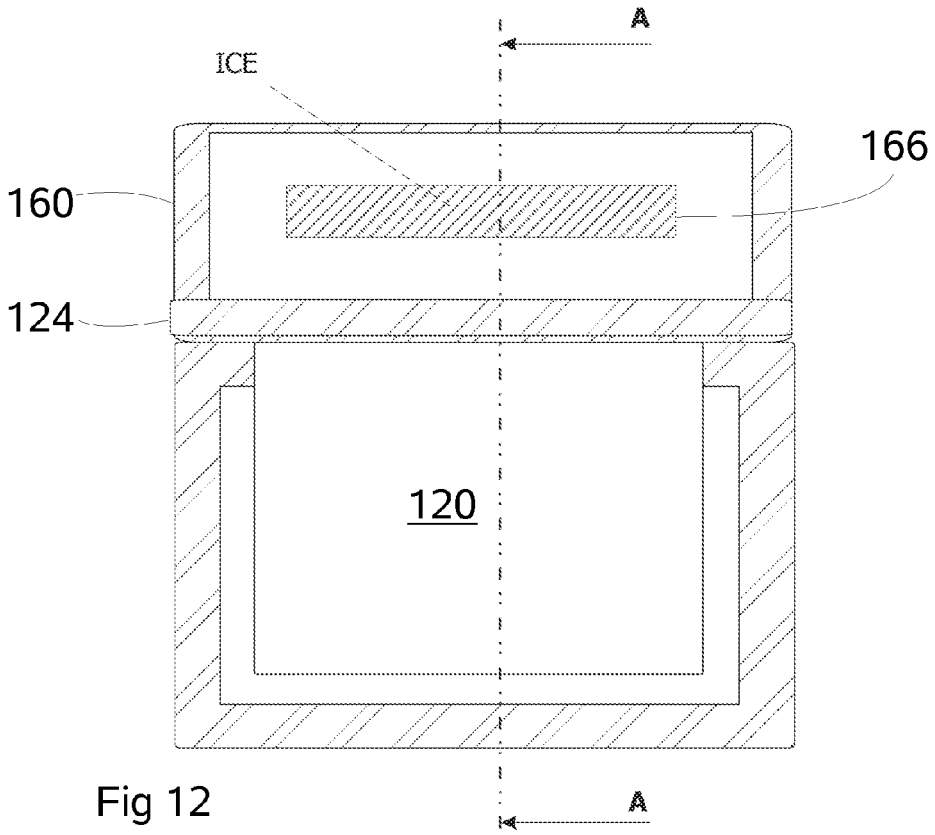
FIGS. 12 and 13 are sectional views of a top-loading refrigerator being a seventh embodiment of the invention.

Further, simpler alternative embodiments of the invention are shown in FIGS. 10 to 13. The embodiment of FIGS. 10 and 11 is similar to the third embodiment, and the embodiment of FIGS. 11 and 12 is similar to the fourth embodiment. In each case, the refrigeration unit 30, 130 and the associated cooling element 32, 132 is omitted. Consequentially, no source of electrical power is required.

Instead, in the embodiment of FIGS. 10 and 11, a watertight compartment 64 is provided. The compartment 64 extends into the headspace at substantially the same location as the freezer compartment 50, 150 of the earlier embodiments. Access to a space within the compartment 64 can be reached from an opening that is closed by a door 24, 152 in much the same way as the freezer compartments 50, 150. The material of the compartment 64 is chosen to have a high thermal conductivity to ensure efficient heat transfer between contents of the compartment 64 and water surrounding it.

For use, the compartment 64 is filled with a body of cold material 66, 166. The body of cold material 66, 166 is at a temperature that is below the intended operating temperature of the payload space 20, 120. It will typically be well below 0° C. A temperature of around −18° C. can be obtained by placing the body in a conventional food freezer before use, and −30° C. or less would emulate the effect of a refrigeration unit. In a manner similar to transfer of heat from the water to the cooling element 32, 132 of preceding embodiments, heat is absorbed by the body of cold material from the water through the material of the compartment 64. In this way, the payload space 20, 120 is cooled by dense water cooled to approximately 4° C. (or to another temperature at which the water and any of its additives is at its densest).

Figure 13:
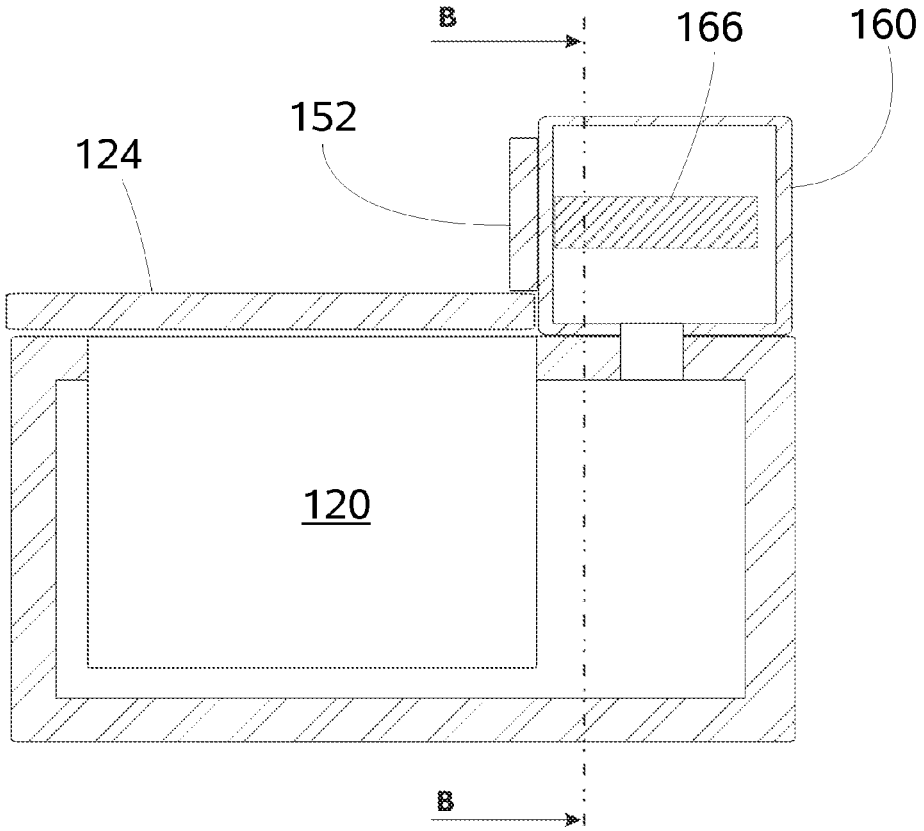

The body of cold material can be anything with a suitable thermal mass. However, water ice is particularly suitable because it is readily available and has an advantageously high latent heat of fusion. The ice may be in the form of standard 0.6 liter ice packs 166 that are used in transport and storage of medical supplies. If ice packs are to be used, the compartment could be omitted altogether, with the ice packs being placed directly within the water of the headspace, as shown in FIGS. 12 and 13. (Of course, the embodiment of FIGS. 12 and 13 could be modified to include a compartment as in the embodiment of FIGS. 10 and 11, and the embodiment of FIGS. 10 and 11 could be modified by the omission of the compartment.)

Figure 14:
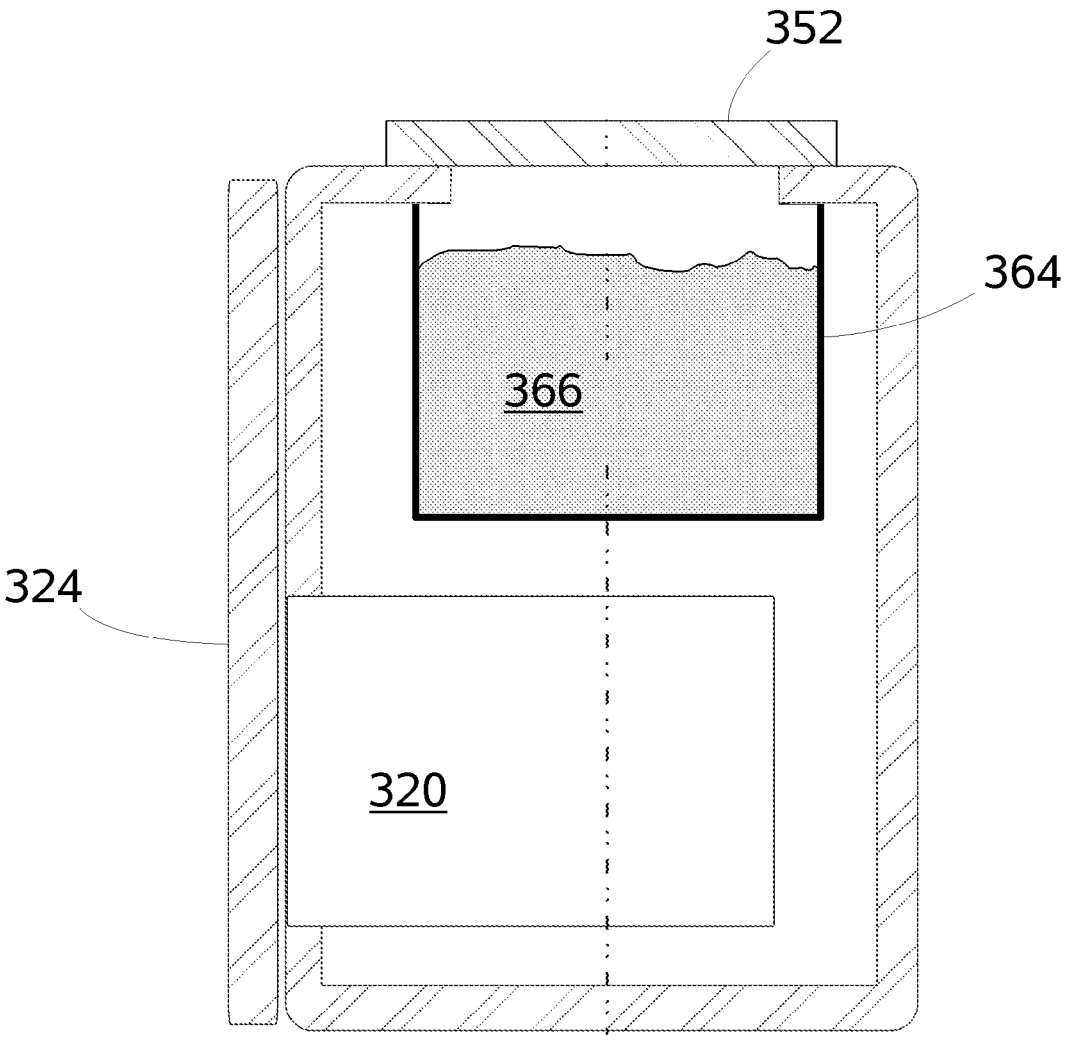
FIG. 14 is a sectional view of an eighth embodiment of the invention.

Another embodiment that makes use of a thermal mass is shown in FIG. 14. In this embodiment, an container 364 is located above the payload container 320 submerged in water within the headspace. The container 364 is formed of a material that allows heat to be transferred from water within the headspace to its contents. The container 364 has an opening through which its interior can be reached from outside of the refrigerator, the opening being closed by a thermally-insulated cover 352. In this embodiment, the opening of the container faces upward when the refrigerator is in use.

This embodiment functions in a manner similar to those described above that make use of a thermal mass. Cold material 366, most typically water ice, is introduced into the container 364 through the opening. Heat then moves from water in the headspace to the ice within the container, thereby cooling the water and the contents of the payload container 320, in accordance with the principles described above. The arrangement of the opening shown in FIG. 14 allows the ice to be introduced quickly and easily into the container.

It is surmised that a refrigerator with a payload space of 60 liters can be maintained within a required temperature range for between 7 and 30 days, with a requirement of 100 liters of ice to achieve the upper end of this range.

Clearly, in all embodiments of the invention, a central requirement is that the water be maintained within the refrigerator in a manner that leakage and evaporation is prevented. This can be quite difficult to achieve for a refrigerator that is likely to be subject to rough handling and shock as it is transported in rugged vehicles on poorly-surfaced roads or entirely off-road. Therefore, one system for constructing a refrigerator embodying the invention is to provide a rigid outer case that provides the overall shape, structural strength and thermal insulation, and to line the case with a watertight liner 80 formed from flexible plastic material. Such a liner is shown in FIGS. 15*a* to 15*c*.

It will be understood that the liner 80 will be shaped and dimensioned in accordance with the particular embodiment with which it will be used, and that the figures illustrate just one example configuration. The example shown in FIGS. 15*a* to 15*c* will be suitable for use in a front-entry refrigerator. It includes a headspace 82, a filling pipe 84, and a recess 86 within which the payload space is contained. The weight of the water causes the material of the liner 80 to deflect, so as to conform closely to the payload space, thereby ensuring effective heat transfer between the payload space and water within the liner 80. Small deflections of or damage to the outer case will not result in leakage of the liner 80. In the event that the liner does leak, it can be replaced readily and at little cost.

Examples of features provided by embodiments of the invention are summarized by reference to one or more of the following numbered paragraphs which recite the original claims from the PCT application:

1. A refrigerator having:

a) a payload container within which items can be placed for temperature-controlled storage;

b) a reservoir within which water is contained, the reservoir having a cooling region in thermal communication with the payload container, the reservoir including a headspace containing water that is, in use, higher than the payload container; and c) cooling means that can cool water within the headspace.

2. A refrigerator according to paragraph 1 in which the cooling means includes a refrigeration unit.

3. A refrigerator according to paragraph 2 further comprising a power supply that can act as a source of power for the refrigeration unit.

4. A refrigerator according to paragraph 3 in which the power supply includes means for converting sunlight into electrical power.

5. A refrigerator according to paragraph 4 in which the means for converting sunlight into electrical power includes a plurality of photovoltaic cells.

6. A refrigerator according to any one of paragraphs 3 to 5 in which the power supply derives power from an external power source.

7. A refrigerator according to paragraph 3 in which the external power source is mains voltage.

8. A refrigerator according to any one of paragraphs 2 to 7 in which the refrigeration unit includes an electrically-powered compressor.

9. A refrigerator according to any one of paragraphs 2 to 7 in which the refrigeration unit includes a Stirling cooler.

10. A refrigerator according to paragraph 9 in which the Stirling cooler operates in solar direct drive mode.

11. A refrigerator according to any one of paragraphs 2 to 10 further comprising a sensor disposed to detect the formation of ice in the reservoir.

12. A refrigerator according to paragraph 11 in which the sensor is operative to cause operation of the refrigeration unit to be interrupted upon detection of the formation of ice.

13. A refrigerator according to any preceding paragraph in which the cooling means includes a thermal mass that, for use, is at a temperature below a target temperature of the payload space.

14. A refrigerator according to paragraph 13 in which the thermal mass is a body of water ice.

15. A refrigerator according to paragraph 13 or paragraph 14 that includes a compartment for receiving the thermal mass.

16. A refrigerator according to paragraph 13 or paragraph 14 in which the thermal mass is immersed in water within the headspace.

17. A refrigerator according to paragraph 15 in which the thermal mass is an ice pack.

18. A refrigerator according to any preceding paragraph in which the payload space is within the cooling region.

19. A refrigerator according to paragraph 18 in which the payload space is submerged within the cooling region.

20. A refrigerator according to any one of paragraphs 1 to 17 in which the cooling region is contained within the payload space.

21. A refrigerator according to paragraph 20 in which the cooling region includes one or more water-carrying passages that extend through the payload space.

22. A refrigerator according to any preceding paragraph in which the headspace is located, in use, directly above the payload container.

23. A refrigerator according to paragraph 22 in which the payload container includes an opening and a closure located on one side of the payload container when the refrigerator is in use.

24. A refrigerator according to any one of paragraphs 1 to 21 in which the headspace is located, in use, to one side of the payload container.

25. A refrigerator according to paragraph 24 in which the payload container includes an opening and a closure located on top of the payload container when the refrigerator is in use.

26. A refrigerator according to paragraph 25 in which the closure is an insulated door carried on the reservoir.

27. A refrigerator according to any preceding paragraph in which a payload space within the payload container is in close thermal communication with the water in the reservoir.

28. A refrigerator according to any preceding paragraph in which the reservoir is insulated to minimise transfer of heat between water within the reservoir and surroundings of the refrigerator.

29. A refrigerator according to any preceding paragraph that further includes a freezer compartment.

30. A refrigerator according to paragraph 29 in which the freezer compartment is in close thermal communication with the cooling means.

31. A refrigerator according to paragraph 29 or paragraph 30 in which the freezer compartment has an opening that is closed by an insulated door.

32. A refrigerator according to any one of paragraphs 29 to 31 in which the insulated door also closes the payload container.

33. A refrigerator according to any preceding paragraph comprising an outer case within which is contained a water-containing liner.

34. A refrigerator according to paragraph 33 in which the liner is formed of flexible plastic material.

35. A refrigerator according to paragraph 33 or paragraph 34 in which the outer case provides structural strength and thermal insulation for the refrigerator.

The invention claimed is:

1. A refrigerator comprising:

a casing surrounding a reservoir within which water is contained in use, the reservoir including:

i) a cooling region; and ii) a headspace disposed substantially above-and in fluid communication with the cooling region;

a payload container within the casing, the payload container having a rigid structure and including a sealed payload space for temperature controlled storage of items, wherein the payload container includes an access panel on the exterior of the casing and at least one other face separating the payload space from the reservoir, the at least one other face made of thermally conductive material and configured such that the payload space is in thermal communication with the cooling region of the reservoir and wherein diffusion of water from above the payload container to below the payload container is unimpeded; and a cooling element that cools water within the headspace, wherein the reservoir is configured such that, in use, water at a temperature of maximum density is permitted to sink from the headspace into the cooling region thereby to cool the payload container towards said temperature by transferring heat via the at least one other face made of thermally conductive material.

2. The refrigerator according to claim 1 in which the cooling element comprises a refrigeration unit.

3. The refrigerator according to claim 2 further comprising a power supply that can act as a source of power for the refrigeration unit.

4. The refrigerator according to claim 3 in which the power supply includes at least one photovoltaic panel that converts sunlight into electrical power.

5. The refrigerator according to claim 3 in which the power supply derives power from an external power source.

6. The refrigerator according to claim 2 in which the refrigeration unit includes an electrically-powered compressor.

7. The refrigerator according to claim 2 in which the refrigeration unit includes a Stirling cooler.

8. The refrigerator according to claim 1 further comprising a sensor disposed to detect the formation of ice in the reservoir.

9. The refrigerator according to claim 8 in which the sensor is operative to cause operation of the refrigeration unit to be interrupted upon detection of the formation of ice.

10. The refrigerator according to claim 1 in which the cooling element comprises a thermal mass that, for use, is at a temperature below a target temperature of the payload space.

11. The refrigerator according to claim 10 in which the thermal mass is a body of water ice.

12. The refrigerator according to claim 10 that includes a compartment for receiving the thermal mass.

13. The refrigerator according to claim 10 in which the thermal mass is immersed in water within the headspace.

14. The refrigerator according to claim 12 in which the thermal mass is an ice pack.

15. The refrigerator according to claim 1 in which the payload container extends into the cooling region of the reservoir.

16. The refrigerator according to claim 15 in which the payload container is submerged within the cooling region.

17. The refrigerator according to claim 1 in which the cooling region includes one or more water-carrying passages that extend through the payload space.

18. The refrigerator according to claim 1 in which the headspace is located, in use, directly above the payload container.

19. The refrigerator according to claim 1 in which the headspace is located, in use, to one side of the payload container.

20. The refrigerator according to claim 1 wherein the casing includes a water-containing liner.

21. The refrigerator according to claim 20 in which the liner is formed of flexible plastic material.

22. The refrigerator according to claim 20 in which the outer case provides structural strength and thermal insulation for the refrigerator.

23. The refrigerator according to claim 1 further comprising a door mounted on the casing and that can be opened to gain access to the payload space through the open face.

24. A refrigerator comprising:

a casing surrounding a reservoir within which water is contained in use, the reservoir having:

i) a cooling region; and ii) a headspace disposed substantially above and in fluid communication with the cooling region; and a payload container within the casing, the payload container having a rigid structure and including a sealed payload space for temperature controlled storage of items, wherein the payload container includes an access panel on the exterior of the casing and at least one other face separating the payload space from the reservoir, the at least one other face made of thermally conductive material and configured such that the payload space is in thermal communication with the cooling region of the reservoir and wherein diffusion of water from above the payload container to below the payload container is unimpeded, wherein the headspace is configured to permit a cooling element to be disposed therein for cooling water within the headspace; and wherein the reservoir is configured such that, in use, water at a temperature of maximum density is permitted to sink from the headspace into the cooling region thereby to cool the payload container towards said temperature by transferring heat via the at least one other face made of thermally conductive material.

25. The refrigerator according to claim 24 further comprising a sensor disposed to detect the formation of ice in the reservoir.

26. The refrigerator according to claim 24 in which the payload container extends into the cooling region of the reservoir.

27. The refrigerator according to claim 24 in which the headspace is located, in use, directly above the payload container.

28. The refrigerator according to claim 24 in which the headspace is located, in use, to one side of the payload container.

29. The refrigerator according to claim 24 wherein the casing includes a water-containing liner.

30. The refrigerator according to claim 24 in which the cooling element comprises a thermal mass that, for use, is at a temperature below a target temperature of the payload space.

31. The refrigerator according to claim 24 further comprising a door mounted on the casing and that can be opened to gain access to the payload space through the open face.

* * * * *